US009027808B2

(12) United States Patent
Kim

(10) Patent No.: US 9,027,808 B2
(45) Date of Patent: May 12, 2015

(54) HOLDERS FOR MOBILE DEVICES

(71) Applicant: David & Young Group Corp., Secaucus, NJ (US)

(72) Inventor: Minsun Kim, New York, NY (US)

(73) Assignee: David & Young Group Corp., Secaucus, NJ (US)

( * ) Notice: Subject to any disclaimer, the term of this patent is extended or adjusted under 35 U.S.C. 154(b) by 192 days.

(21) Appl. No.: 13/746,972

(22) Filed: Jan. 22, 2013

(65) Prior Publication Data

US 2014/0202886 A1 Jul. 24, 2014

(51) Int. Cl.
*A45F 5/00* (2006.01)
*A45C 11/00* (2006.01)

(52) U.S. Cl.
CPC . *A45F 5/00* (2013.01); *A45C 11/00* (2013.01); *A45F 2005/008* (2013.01)

(58) Field of Classification Search
USPC ..... 224/218, 651, 673
See application file for complete search history.

(56) References Cited

U.S. PATENT DOCUMENTS 2,283,988 A * 5/1942 Heath ..... 401/6
D265,694 S 8/1982 Sogoian et al.
4,412,106 A * 10/1983 Pavel ..... 381/309
4,753,377 A * 6/1988 Poluhowich ..... 224/163
5,370,622 A * 12/1994 Livingston et al. ..... 604/151
5,388,742 A * 2/1995 Ethridge et al. ..... 224/255
5,410,762 A * 5/1995 Maskovich ..... 2/338
5,526,924 A * 6/1996 Klutznick ..... 206/5
5,653,336 A * 8/1997 Buonaiuto et al. ..... 206/320
6,105,923 A * 8/2000 Robertson et al. ..... 248/682
6,651,854 B1 11/2003 LaCoste
7,469,809 B2 * 12/2008 Rodarte et al. ..... 224/578
D609,464 S 2/2010 Bullen
D618,230 S * 6/2010 Brown et al. ..... D14/250
7,780,047 B2 * 8/2010 Chen et al. ..... 224/218
8,079,329 B1 12/2011 Pujol et al.
8,567,832 B2 * 10/2013 Kannaka ..... 294/25
2001/0054633 A1 * 12/2001 Marston ..... 224/673
2009/0039121 A1 2/2009 Paul
2009/0088230 A1 4/2009 Park
2010/0176174 A1 * 7/2010 Felts ..... 224/666
2012/0063066 A1 * 3/2012 Floit ..... 361/679.01
2012/0255978 A1 10/2012 Williams

* cited by examiner

*Primary Examiner* — Brian D Nash
(74) *Attorney, Agent, or Firm* — Susan Paik, Esq.

(57) ABSTRACT

An attachment system includes a case having a bottom including at least two slots, a strap inserted into the at least two slots of the case, and at least one add-on piece attached to the strap. The strap includes an attachment means, and the at least one add-on piece may include interchangeable jewelry pieces.

4 Claims, 8 Drawing Sheets

HOLDERS FOR MOBILE DEVICES

TECHNICAL FIELD

The present disclosure generally relates to holders and attachment systems for mobile devices, and more particularly to a multi-purpose strap and fashion accessory device to help secure a mobile device to the user in a manner which provides enhanced functionality and aesthetic appeal.

BACKGROUND

Mobile devices such as cell phones and smart phones are often carried by users at virtually all times. Many such devices, especially smartphones with their larger screens, are especially costly and delicate, and have a shape which is slippery, non-ergonomic and difficult to grasp securely. Dropping the mobile device during use could result in significant damage.

A number of protective cases and covers for mobile devices have been developed over the years. Covers for devices such as smart phones are often selected not only for improving grip and protection, but increasingly for appearance and their aesthetic appeal.

However, there remains a need for a device which can incorporate a protective cover with improved grip while also optimizing and improving aesthetic appeal.

SUMMARY

Accordingly, holders for a mobile device and methods of use are provided.

In one embodiment, an attachment system is provided comprising a case having a bottom including at least two slots, a strap inserted into the at least two slots of the case, and at least one add-on piece attached to the strap.

In another embodiment, an attachment system for a mobile device is provided comprising a case having a bottom including a recess, at least two slots disposed at opposing ends of the recess, a strap inserted into the recess and the at least two slots of the case, and at least one add-on piece attached to the strap In yet another embodiment, an attachment system for a mobile device is provided comprising a case having a bottom including at least two slots, a strap inserted into the at least two slots of the case, the strap having at least one hole; and at least one add-on piece attached to the at least one hole in the strap.

These and other aspects, features and advantages of the present disclosure will be described or become apparent from the following detailed description, which is to be read in connection with the accompanying drawings.

BRIEF DESCRIPTION OF THE DRAWINGS

The present disclosure will become more readily apparent from the specific description accompanied by the following drawings, in which.

Like reference numerals indicate similar parts throughout the figures.

Figure 1:
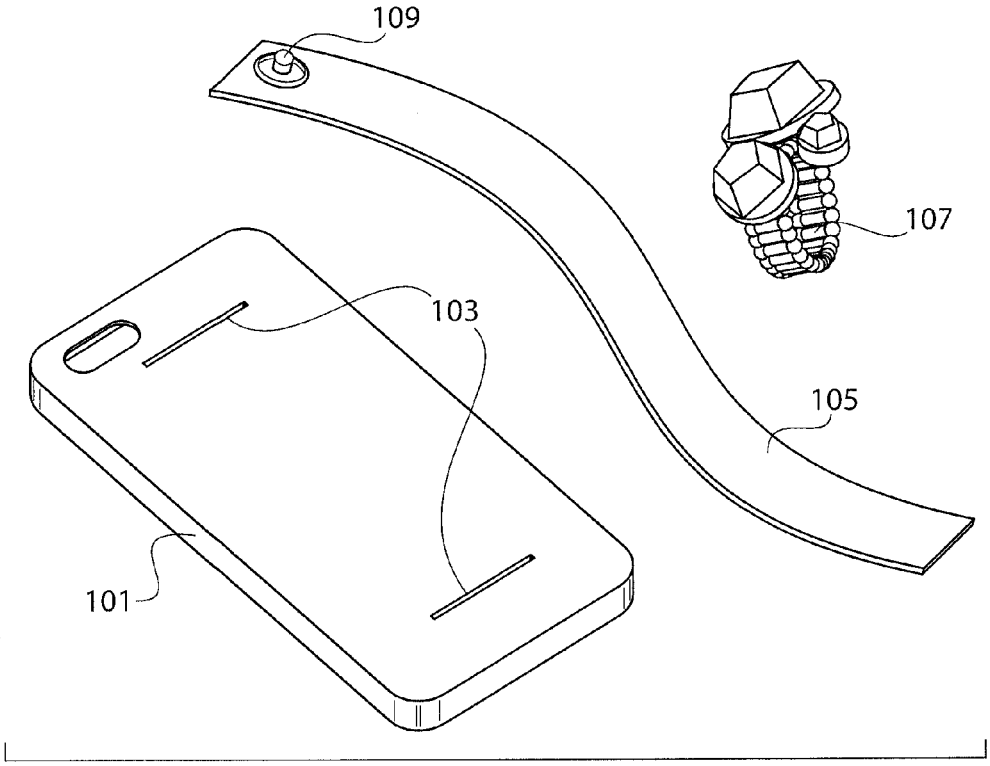
FIG. 1 is a perspective view of elements of an attachment system for a mobile device in accordance with one embodiment of the present disclosure.

It is to be understood that the figures are not drawn to scale. Further, the relation between objects in a figure may not be to scale, and may in fact have a reverse relationship as to size. The figures are intended to bring understanding and clarity to the structure of each object shown, and thus, some features may be exaggerated in order to illustrate a specific feature of a structure.

DETAILED DESCRIPTION OF PREFERRED EMBODIMENTS

The exemplary embodiments of attachments and holders for mobile devices and related methods of use disclosed are discussed in terms of cases and holders to provide improved functionality such as protection and secure attachment of mobile devices to a user as well as improved aesthetic appeal.

It is envisioned that attachments and holders for mobile devices may be employed with additional devices, features and/or methods for providing additional functionality.

The present disclosure may be understood more readily by reference to the following detailed description of the disclosure taken in connection with the accompanying drawing figures, which form a part of this disclosure. It is to be understood that this disclosure is not limited to the specific devices, methods or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of attachments and holders for mobile devices, and related methods of using same in accordance with the principles of the present disclosure. Alternate embodiments are also disclosed. Reference will now be made in detail to certain exemplary embodiments of the present disclosure, examples of which are illustrated in the accompanying figures. While the application will be described in conjunction with the illustrated embodiments, it will be understood that they are not intended to limit the application to those embodiments. On the contrary, the application is intended to cover all alternatives, modifications, and equivalents, which may be included within the application as defined by the appended claims.

The headings below are not meant to limit the disclosure in any way; embodiments under any one heading may be used in conjunction with embodiments under any other heading.

Turning now to FIGS. 1-16, there are illustrated components of attachment systems and holders for mobile devices in accordance with principles of the present disclosure.

FIG. 1 is a perspective view of elements of an attachment system for a mobile device (mobile device not shown) in accordance with one embodiment of the present disclosure. The mobile device may comprise any device, e.g., electronic devices such as mobile phones, smartphones, PDAs, etc., or non-electronic devices, either of which are preferably portable or handheld.

In one exemplary embodiment, the system may comprise a case 101 comprising a rectangular shape having a bottom side including at least two slots 103 positioned at opposite ends thereof. The case 101 may comprise a rectangular shape, as shown; however, alternate shapes may be contemplated. Preferably, the slots 103 comprise substantially linear openings or voids which pass through the case 101 and which are oriented to have a length substantially perpendicular to a length of the case 101. The slots 103 may be of any thickness or shape to enable pass-through of a strap 105.

The case 101 can be fabricated from any substantially rigid and/or flexible materials, including metals, synthetic polymers, plastics, rubber, carbon fiber, wood and/or their composites and combinations thereof, depending on the properties desired. Various components of the case 101 may have material composites, including the above materials, to achieve various desired characteristics such as strength, rigidity, resiliency, elasticity and/or durability. The case 101 may comprise any desired size and be monolithically formed and/or be comprised of integrally connected parts.

A strap 105 having an attachment means 109 may be provided configured to be insertable into the slots 103. As used herein, the term "attachment means" may comprise snaps, buttons, latches, hook and loop fasteners, and any other type of fastener, and may further be adjustable in size. The attachment means 109 may be placed on opposite ends of the strap 105 to enable the strap ends to be fastened together.

In various embodiments, opposing ends of the strap 105 may be inserted into the slots 103 so as to protrude from a rear side of the case 101. The strap 105 may be comprised of any flexible and/or resilient material, for example, leather, vinyl, plastic, fabric comprised of natural or synthetic fibers, elasticized fabrics, etc. and any combination thereof.

One or more add-on pieces 107 configured to be attachable to the strap 105 may be provided. The add-on piece 107 may comprise, e.g., a ring; however, as used herein, the term "add-on piece" may comprise any item in any shape or design, e.g., any decorative item or piece of jewelry may be contemplated. Preferably, the add-on piece 107 is configured to be affixable to the strap 105. The attachment means 109 of the strap 105 can then be affixed to connect the strap ends, thus securing the add-on piece 107 onto the strap and enabling the strap to be looped over the hand during use.

The add-on piece 107 can be used or worn separately by the user, e.g., as a ring on the finger, when not attached to the strap 105. Further, all add-on pieces 107 may be freely interchangable. The add-on pieces may include a loop through which the strap 105 can be slidably inserted. Alternatively, the add-on piece(s) may include clips, brackets, pins, or any other attachment means which would enable movable or stationary affixation of the add-on piece 107 to the strap 105.

Figure 2:
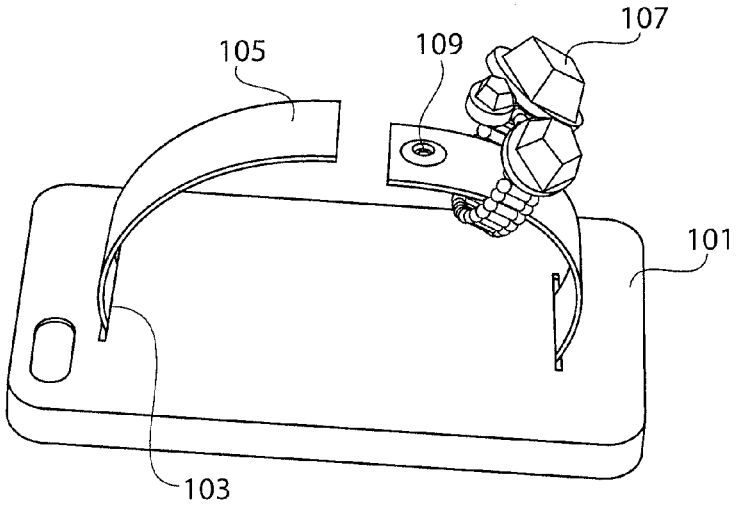
FIG. 2 is a perspective view of the elements of FIG. 1 in an assembled configuration in accordance with the principles of the present disclosure.

FIG. 2 is a perspective view of the elements of FIG. 1 in an assembled configuration in accordance with the principles of the present disclosure. The strap 105 can be affixed to the case 101 through the slots 103 and have an add-on piece 107 slid thereon. Ends of the strap 105 may be secured together via attachment means 109.

Figure 16:
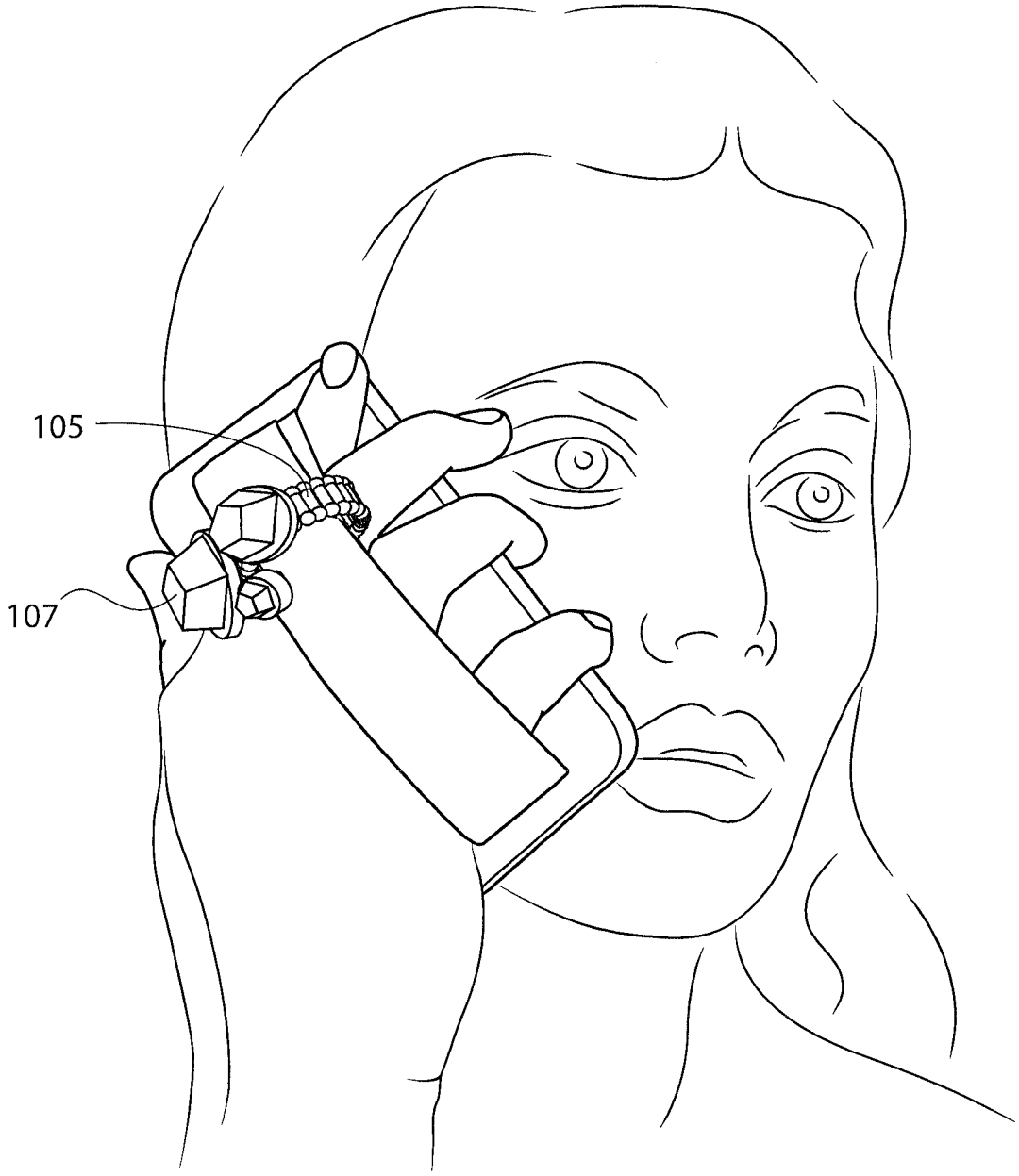
FIG. 16 is a view of an exemplary attachment system for a mobile device in use.

In use, e.g., as shown in FIG. 16, a user can hold the case 101 with the fingers passing through the strap 105, thus providing a secure grip, with the add-on piece 107 attached to and visible on the exterior of the strap to add a decorative and fashionable appearance.

Figure 3:
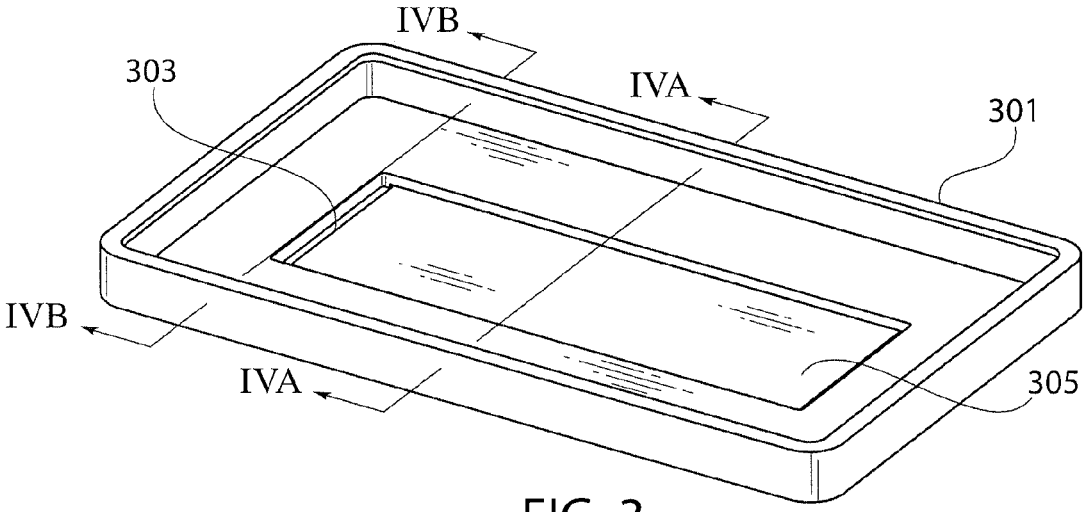
FIG. 3 is a perspective top view of a case for a mobile device according to another embodiment of the present disclosure.
Figure 4A:
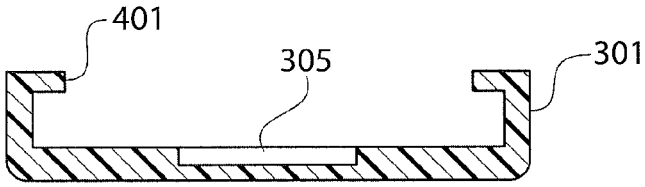
FIG. 4A is a cross-sectional view taken along line IVA-IVA of FIG. 3.
Figure 4B:
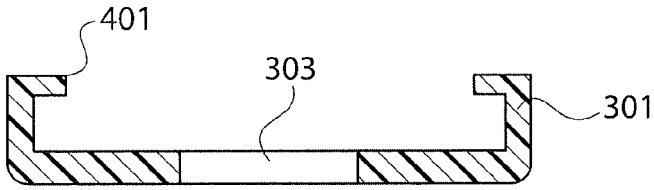
FIG. 4B is a cross-sectional view taken along line IVB-IVB of FIG. 3.

FIG. 3 is a perspective top view of a cover 301 for a mobile device according to another embodiment of the present disclosure. In some embodiments, the cover 301 may be configured to be affixed to a bottom of a mobile device, such as a smart phone, to leave the screen of the phone exposed. FIG. 4A is a cross-sectional view taken along line IVA-IVA of FIG. 3. FIG. 4B is a cross-sectional view taken along line IVB-IVB of FIG. 3.

In this exemplary embodiment, the cover 301 may comprise a polygonal (e.g., rectangular) shape defined by sidewalls having a lip 401 and a bottom side 307 including a recess 305. The recess 305 may comprise a rectangular shape disposed in substantially a center of the bottom 307 and is preferably of a size (e.g., depth, width and length) to accommodate a strap inserted therein, to help minimize bulk and enable the cover 301 to securely be affixed to a mobile device without falling off.

Although a rectangular shape of the case and recess is shown in the Figures, this is for exemplary purposes only and alternate shapes, configurations and sizes may be contemplated.

At least two slots 303 may be provided disposed at opposite ends of the recess 305. Each of the two slots 303 is preferably of a size and thickness sufficient to enable pass-through of a strap, e.g., as described herein.

Figure 5:
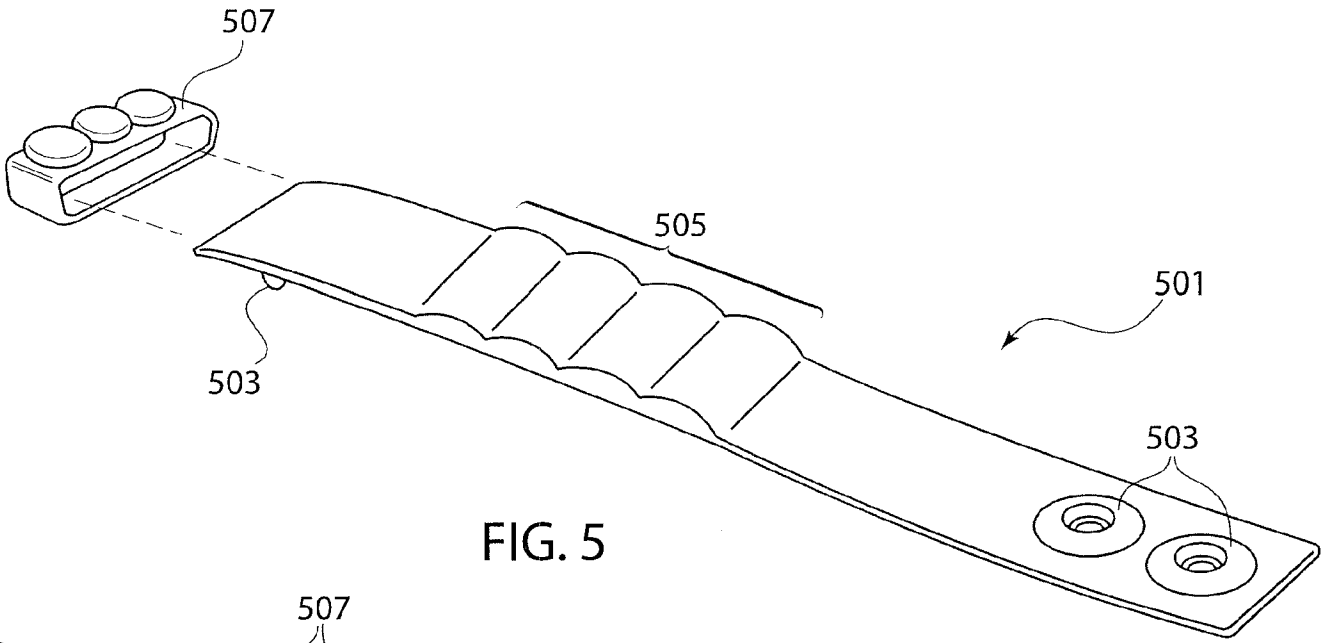
FIG. 5 is a perspective view of a strap attachment with an add-on piece in accordance with the principles of the present disclosure.
Figure 6:
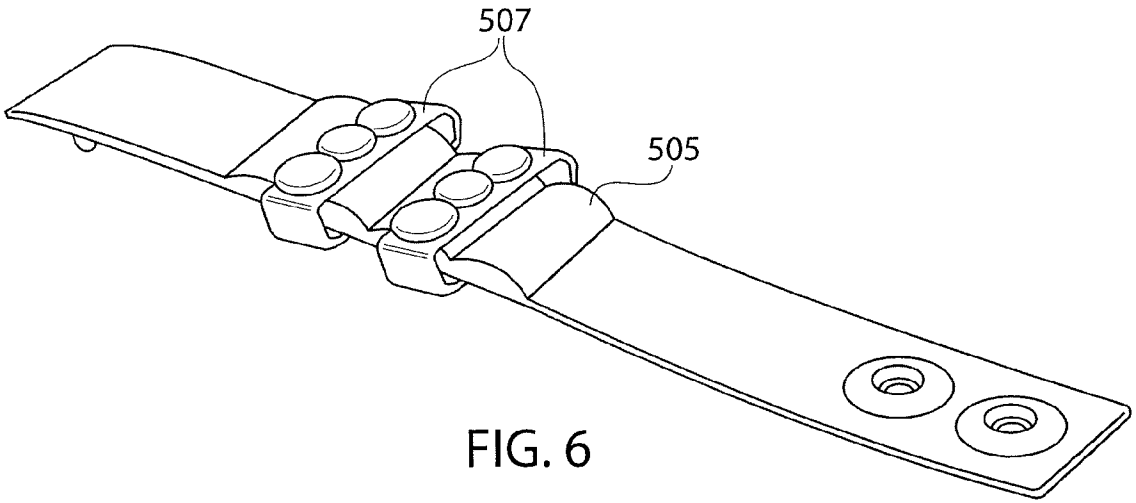
FIG. 6 is a perspective view of the strap attachment of FIG. 5 with assembled add-on pieces in accordance with the principles of the present disclosure.

For example, FIGS. 5 and 6 are perspective views of a strap 501 with one or more add-on pieces 507 in accordance with principles of the present disclosure. The strap 501 may further include attachment means 503 (e.g., snaps, buttons, hook and loop fasteners, etc.) and one or more protuberances 505. For example, a series of adjacent protuberances 505 may be provided along the strap 501, as shown. The protuberances 505 may comprise a series of bumps which define dips 509 in between.

The add-on pieces 507 may comprise rectangular-shaped pieces of any decorative design or jewelry piece defining a cavity which can slidably receive the strap 501 and be fitted over the protuberances 505. Advantageously, once the add-on pieces 507 are assembled onto the strap 501, the protuberances 505 help maintain the position of the add-on pieces 507 with respect to the strap 501 (e.g., help prevent their rotation or excessive sliding or slippage along the strap 501). Thus, the aesthetic appearance and decorative effect of the add-on pieces 507 is optimized.

Figure 7:
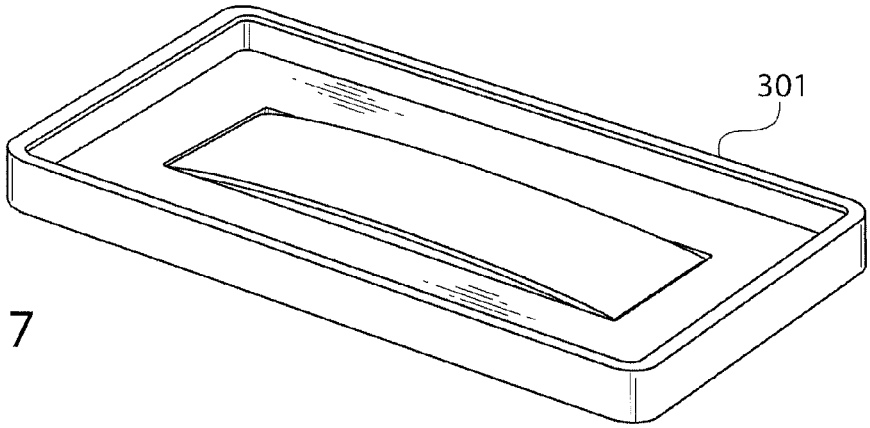
FIG. 7 is a perspective top view of the case of FIG. 3 including an installed strap attachment in accordance with the principles of the present disclosure.
Figure 8:
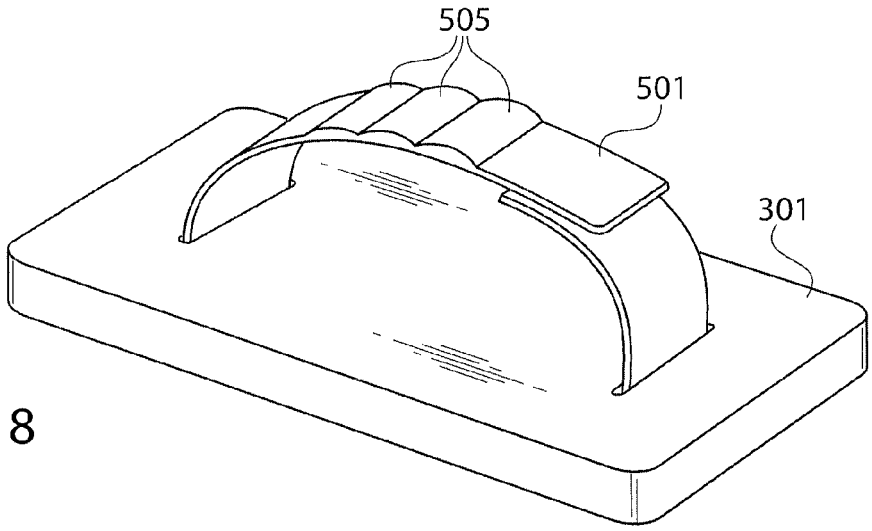
FIG. 8 is a perspective bottom view of the case of FIG. 7 showing a strap attachment in accordance with the principles of the present disclosure.
Figure 9:
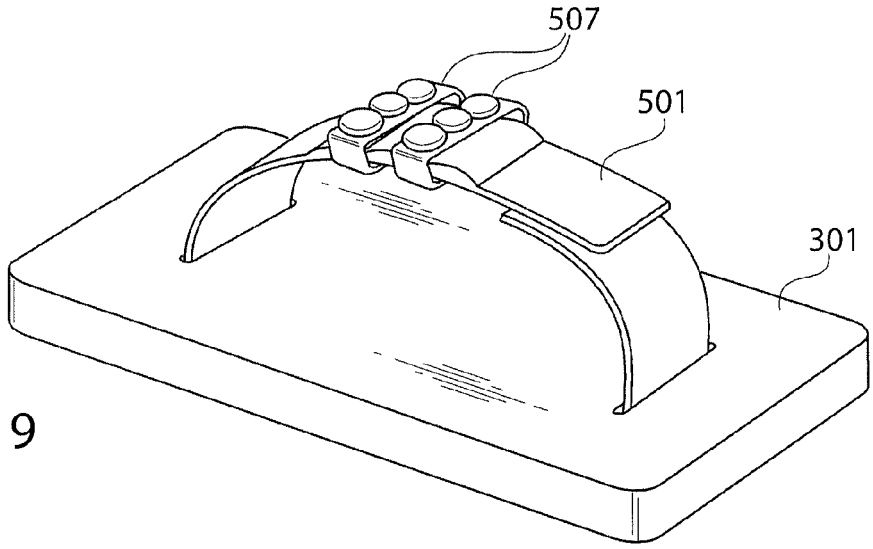
FIG. 9 is a perspective bottom view of the case of FIG. 7 showing a strap attachment with add-on pieces in accordance with the principles of the present disclosure.

FIG. 7 is a perspective top view of the case of FIG. 3 including an installed strap attachment in accordance with the principles of the present disclosure. As shown, the strap 501 having protuberances 505 may be inserted into the slots 303 and lays flat within the recess 305. The ends of the strap 501 can be fastened together to form a bracelet or hand strap, as shown, e.g., in FIG. 8. Optionally, one or more add-on pieces 507 may be slid onto the strap 501 and the strap ends then affixed together, as shown in FIG. 9.

Figure 11:
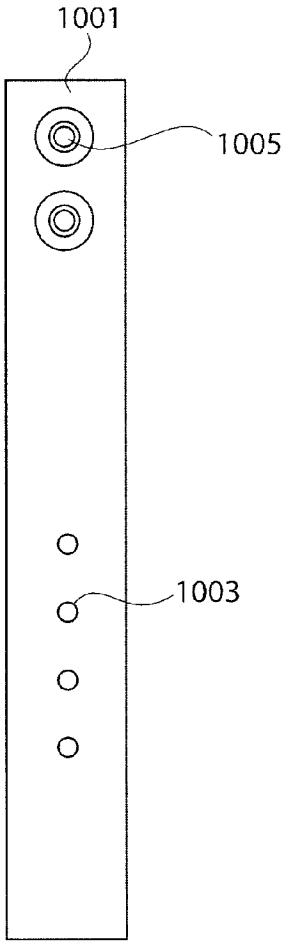
FIG. 11 is a bottom view of the strap of FIG. 10.
Figure 10:
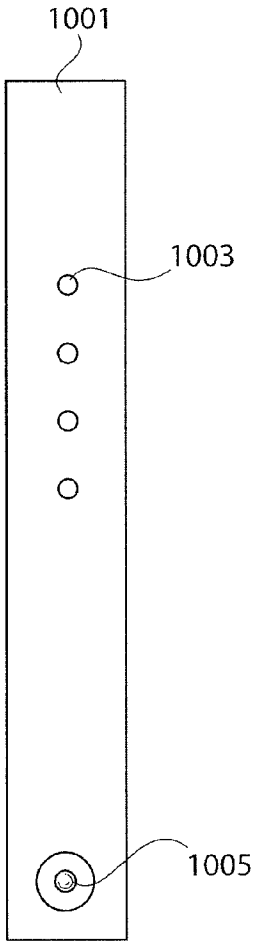
FIG. 10 is a top view of a strap according to another embodiment of the present disclosure.

FIGS. 10 and 11 are top and bottom views, respectively, of a strap 1001 according to another embodiment of the present disclosure. In exemplary embodiments, the strap 1001 includes one or more holes 1003 disposed along its length and one or more attachment means 1005. The holes 1003 may be oriented linearly along the strap 1001, as shown, or in any other configuration (double rows, boxes, wavy lines, shapes, etc.) Furthermore, the holes 1003 may be of uniform or varying sizes, e.g., to accommodate various sizes of add-on pieces.

Figure 12:
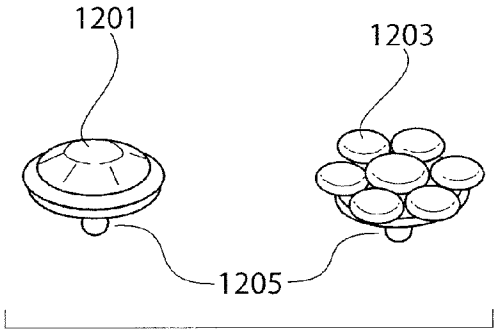
FIG. 12 shows perspective views of exemplary add-on pieces according to another embodiment of the present disclosure.
Figure 13:
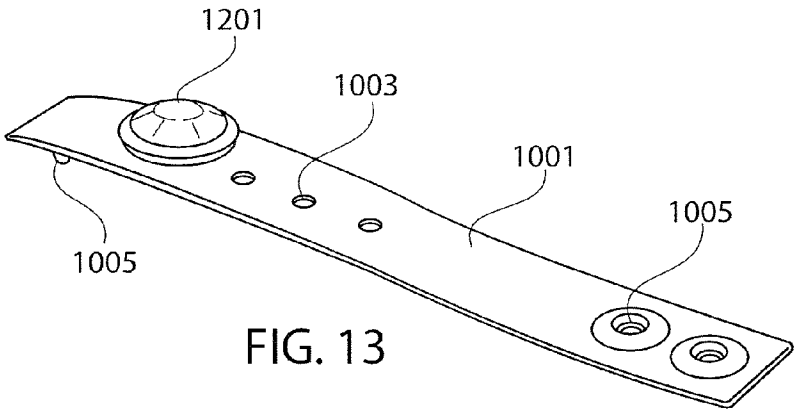
FIG. 13 is a perspective view of the strap of FIG. 10 showing affixed add-on pieces in accordance with the principles of the present disclosure.

FIG. 12 shows perspective views of exemplary add-on pieces 1201, 1203 according to another embodiment of the present disclosure. Add-on pieces 1201, 1203 may comprise any design, shape or size, and include a knob 1205 configured for secure insertion into any of the one or more holes 1003 of the strap 1001. Accordingly, the add-on pieces 1201, 1203 may be arranged and affixed to the strap 1001 at any location thereon, and may be freely interchangeable. FIG. 13 is a perspective view of the strap of FIG. 10 showing affixed add-on piece 1201 in accordance with the principles of the present disclosure.

Figure 14:
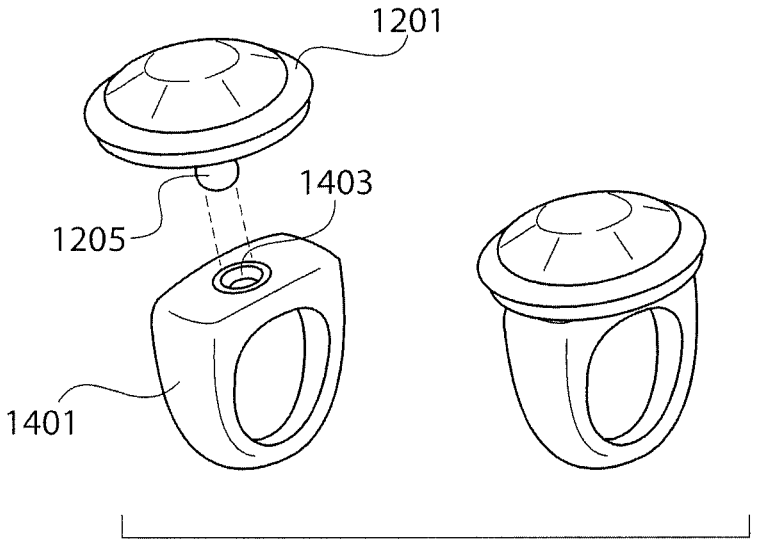
FIG. 14 is a perspective view of an accessory ring with an attached add-on piece in accordance with the principles of the present disclosure.

Furthermore, e.g., as shown in FIG. 14, the add-on pieces 1201, 1203 may be inserted into other objects, such as a ring 1401 having an aperture 1403 adapted to securely accept the knob 1205.

Additional structures to improve the secure attachment of the add-on pieces may be contemplated, such as backings or plugs adapted to further secure the knob 1205 within the hole 1003 and prevent it from slipping out.

Figure 15:
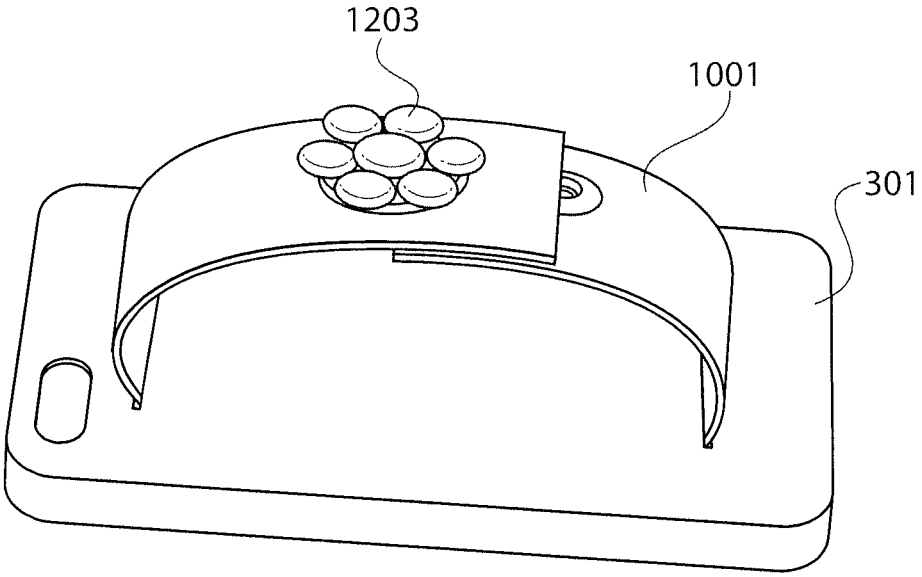
FIG. 15 is a perspective view of a case showing the strap attachment of FIG. 10 with an affixed add-on piece in accordance with the principles of the present disclosure.

FIG. 15 is a perspective view of a case showing the strap attachment of FIG. 10 with an affixed add-on piece 1203 in accordance with the principles of the present disclosure.

FIG. 16 depicts an exemplary attachment system comprising a handheld mobile device including a strap 105 having an add-on piece 107 as held by a user during operation of the device.

Figure 17:
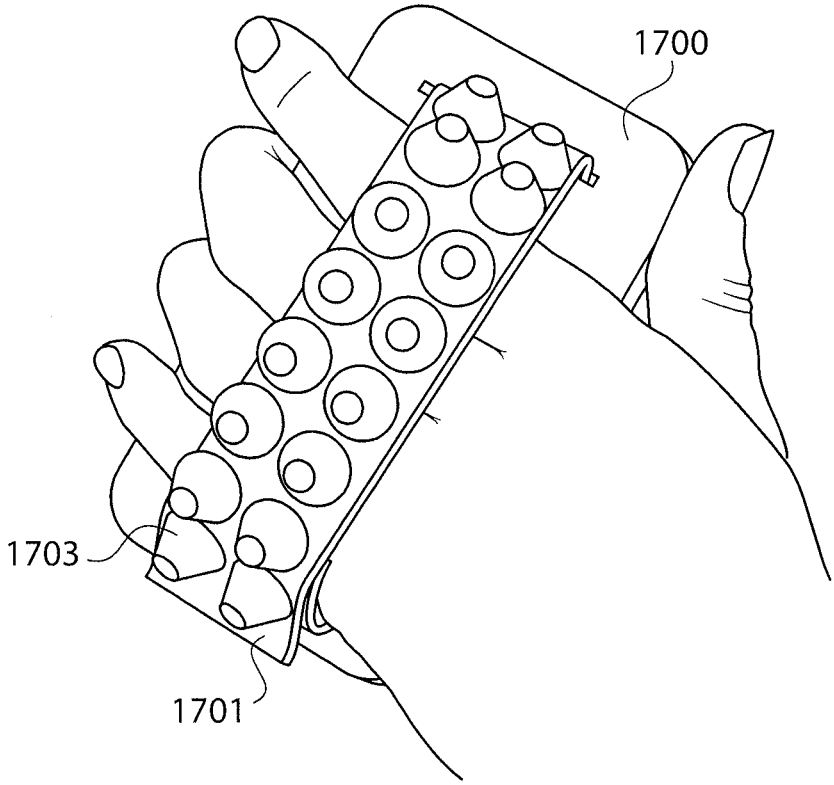
FIG. 17 is a view of an exemplary attachment system for a mobile device according to another embodiment.

FIG. 17 is a view of an exemplary attachment system for a mobile device according to another embodiment. In this exemplary embodiment, a strap 1701 is provided configured to be attached to a case 1700, the strap 1701 having a plurality of projections 1703 arranged and affixed thereon, e.g., in one or more rows along the strap 1701. The projections 1703 may comprise knobs or studs of a size which preferably adds weight and substance to the strap 1701, and of a shape (e.g., cone-shaped, oval, rounded, pyramidal, polygonal, etc.) which enables the strap 1701 to function as a stand for the mobile device 1700 (as shown in FIG. 18).

For example, the projections 1703 may comprise studs which are at least ½ inch in length and at least ½ inch in width. Preferably, the projections 1703 may have a length of from about ½ inch to about 1 inch and a width of from about ½ inch and 1 inch. Larger or smaller sizes of the projections 1703 may be completed to provide a desired angle when the attachment system is used in a 'stand' mode, e.g., as shown in FIG. 18. While the projections 1703 may be provided having a substantially uniform size, shape and distribution, in various embodiments, the projections 1703 may be provided on a strap 1701 having any combination of differing sizes, shapes and patterns of distribution (e.g., staggered arrangement, etc.)

Figure 18:
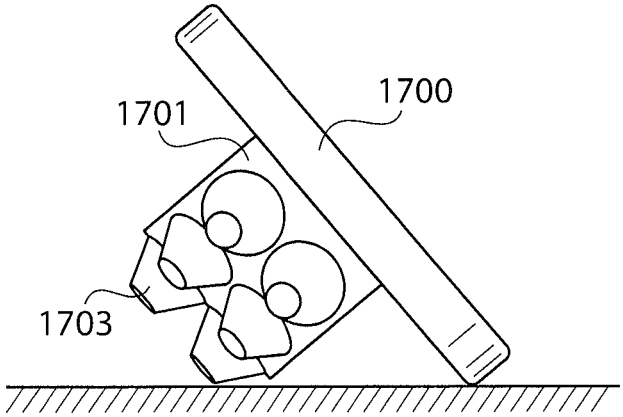
FIG. 18 is a view of the attachment system of FIG. 17 during use as a stand for a mobile device according to an aspect of the present principles.

FIG. 18 is a view of the attachment system of FIG. 17 during use in a 'stand' mode for a mobile device according to an aspect of the present principles. Preferably, the size, shape and arrangement of the projections 1703 enable the strap 1701 to act effectively as a prop to counter the weight of the mobile device in the case 1700, when tilted sideways. Thus, a user may view the mobile device screen at a more convenient angle (e.g., approximately from about 25 degrees to about 60 degrees) in a hands-free manner by allowing the case 1700 to rest against the strap 1701 and projections 1703. The size/shape/arrangement of the projections 1703 may be configured or altered to adjust the angle at which the case 1700 is held in a 'stand' mode. In various embodiments, individual projections 1703 may be configured to be removable/detachable to enable a user to customize the angular adjustment of the 'stand' mode.

In various embodiments, attachment systems comprising any combination of features discussed herein may be contemplated, such as, but not limited to, e.g., straps with any combination of holes and protuberances, etc.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. An attachment system for a mobile device comprising:

a case having a bottom including at least two slots;

a strap inserted into the at least two slots of the case, the strap having at least one hole; and at least one add-on piece attached to the at least one hole in the strap, wherein the at least one add-on piece includes a knob inserted into the at least one hole in the strap and further comprising a ring having a aperture, wherein the at least one add-on piece is insertable into the aperture.

2. The attachment system of claim 1, wherein the bottom of the case includes a recess, and the at least two slots are disposed at opposing ends of the recess.

3. The attachment system of claim 1, wherein the strap includes an attachment means.

4. The attachment system of claim 1, wherein the strap includes a plurality of holes, and the at least one add-on piece is insertable into each of said plurality of holes.

* * * * *